US008608584B1

(12) United States Patent
Cobb

(10) Patent No.: US 8,608,584 B1
(45) Date of Patent: Dec. 17, 2013

(54) GOLF SWING TRAINING DEVICE

(71) Applicant: Terry L. Cobb, Anniston, AL (US)

(72) Inventor: Terry L. Cobb, Anniston, AL (US)

( * ) Notice: Subject to any disclaimer, the term of this patent is extended or adjusted under 35 U.S.C. 154(b) by 0 days.

(21) Appl. No.: 13/889,913

(22) Filed: May 8, 2013

(51) Int. Cl.
*A63B 69/36* (2006.01)

(52) U.S. Cl.
USPC ..... 473/218; 473/278

(58) Field of Classification Search
USPC ..... 473/218, 266, 270, 272, 273, 278
See application file for complete search history.

(56) References Cited

U.S. PATENT DOCUMENTS 3,550,946 A * 12/1970 Duino et al. ..... 473/218
4,084,822 A 4/1978 Keeton
4,465,281 A 8/1984 Whitfield
4,925,192 A * 5/1990 Forbes ..... 473/273
5,171,017 A * 12/1992 Betancourt ..... 473/218
5,224,709 A 7/1993 Buck, Jr.
5,827,125 A * 10/1998 Lee ..... 473/139
8,025,585 B2 * 9/2011 Kramski ..... 473/218

* cited by examiner

*Primary Examiner* — Nini Legesse

(57) ABSTRACT

A golf swing training device including a mat having a contact plate disposed therein over which the golf club passes during correct ball contact and a plurality of apertures disposed at predetermined locations in the mat in which pegs are inserted to arrange a desired swing path for a right-handed or left-handed golfer's club swing for either the woods and the driver or the irons. An alignment tube, which is fixed and alternately telescopic, attached to a cylindrical female connector on either of the mat right and left sides and a T-shaped tube connector to which a pair of alignment rods is attached align the golfer's feet in a position parallel to the mat sides. An alignment arrow on the mat top surface provides a visual cue for a correct forward follow through. Stakes driven through holes in the mat secure the mat to a ground surface for outdoor use.

20 Claims, 4 Drawing Sheets

GOLF SWING TRAINING DEVICE

BACKGROUND OF THE INVENTION

Various types of golf training aids directed toward training a golfer in learning proper swing form and mechanics are known in the prior art. Some of these devices are designed for only right-handed golfers. Other devices teach a golfer to align and aim for various golf ball flight trajectories. Another device provides illustrations of proper body positions on a mat for a golf swing for different types of golf shots. U.S. Pat. No. 4,913,440 provides guide members to teach a golfer a variety of desirable golf club swing paths, but does not provide structures designed to simultaneously position a golfer in the correct parallel position with respect to the swing path while making correct ball contact, and further fails to provide a tee upon which to place a golf ball in proper position. However, the present device addresses the foregoing issues by providing an effective golf swing training device including a mat having a contact plate disposed therein over which the golf club passes, but does not contact, to teach a golfer correct ball contact and a plurality of apertures disposed at predetermined locations in the mat in which pegs are inserted to arrange a desired swing path for a right-handed or left-handed golfer's club swing for either the woods and the driver or the irons. An alignment tube, which is fixed or alternately telescopic, attached to a cylindrical female connector on either of the left or right side of the mat and a T-shaped tube connector to which a pair of alignment rods is attached align the golfer in a position parallel to the mat sides. An alignment arrow on the mat top surface provides visual and physical cues for a correct forward follow through. Stakes driven through holes in the mat secure the mat to a ground surface for outdoor use.

FIELD OF THE INVENTION

The present invention relates to golf training aids, and more particularly, to a golf swing training device.

SUMMARY OF THE INVENTION

The general purpose of the present golf swing training device, described subsequently in greater detail, is to provide a golf swing training device which has many novel features that result in a golf swing training device which is not anticipated, rendered obvious, suggested, or even implied by prior art, either alone or in combination thereof.

To accomplish this, the present golf swing training device is provided to teach a golfer correct body alignment with respect to a target location on a golf course, such as a pin on the green, as well as a consistently correct golf swing that ultimately improves the golfer's score by including a planar mat over which a golfer strikes a golf ball, a contact cavity in the mat with a contact plate disposed therein over which the golf club should pass, when correctly executing a golf swing, and a plurality of apertures disposed at predetermined locations spaced about the mat in which pegs of varying length are inserted to arrange a desired swing path, such as for a right-handed golfer's driver swing or a left-handed golfer's iron swing.

The contact plate has an upper surface disposed in a position flush with the mat top surface. The purpose of the contact plate is to provide practice to teach a golfer correct ball contact. If the club contact is incorrect, the golfer will hit the contact plate with the golf club. The contact plate is durable and resilient to prevent damage to a golf club upon contact with the contact plate.

The apertures include a central aperture in the mat in a location upon which a golf tee is normally placed and circular first and second side apertures disposed between the contact cavity and the right and left sides of the mat, respectively, in a position more proximal the contact cavity than the respective right side and left side. A pair of circular rear apertures is disposed between each of the first side aperture and the second side aperture and the rear end of the mat in an offset position toward the respective right and left sides of the mat in a position more proximal the rear end than each of the respective right and left sides of the mat. A pair of circular front apertures is centrally disposed between the central aperture, the front end of the mat, and the respective right side and left side. A synthetic turf generally covers the entire top surface to simulate the turf on a golf course thereby aiding the golfer to practice correct golf swings with visual and physical cues provided by the instant device.

To train a golfer in proper feet placement during a golf swing, the device includes a cylindrical female connector attached to each of the right and left sides of the mat. A cylindrical alignment tube, which is fixed or telescopic, is attached to the female connector to accommodate the swing plane of a golfer based on factors such as height, arm length, and the length of the particular club used during golf swing practice using the present device. A cylindrical T-shaped tube connector has an inside edge attached to the outer edge of the alignment tube and a pair of outside edges to which a pair of cylindrical alignment rods is attached. Upon attachment to the tube connector, the alignment rod is disposed in a position parallel to the female connector on the respective right side and left side of the mat to accommodate a right-handed and alternately a left-handed golfer. A plurality of durable resilient upright pegs is selectively disposed in the apertures to permit a golfer to define a desired club swing path for the woods and the driver as well as for irons for either a left-handed or a right-handed golfer. The pegs include tee pegs that serve as a tee for a golf ball, elongated pegs for golf swing practice using the woods and the driver, and mid-length pegs for golf swing practice using the irons. An alignment arrow disposed on the mat top surface of the mat trains a golfer to swing a club in a correct swing path by providing a visual aid for a correct forward follow through during a swing. Stakes driven through stake holes disposed through the mat permit outdoor use of the mat by securing the mat to a ground surface.

To use the present device, a golfer selects a desired swing path depending on whether the golfer is right-handed or left-handed and whether the golfer is using a wood or driver or, alternately, an iron and places the pegs into the apertures through the mat accordingly. To train the right-handed or the left-handed golfer to correctly swing one of the woods or the driver, the golfer inserts one elongated peg into the rear aperture proximal the right side (left side for the left-handed golfer) of the mat and one elongated peg into the front aperture proximal the left side (right side for the left-handed golfer) of the mat and over each of the contact plate and the tee peg to define a first swing path and alternate second swing path. For the right-handed golfer and, alternately, the left-handed golfer, both third and fourth swing paths are defined by an area of the top surface of the mat between the mid-length peg disposed in the side aperture disposed proximal the right side (left side for the left-handed player) of the mat and the elongated peg disposed in the front aperture proximal the left side (right side for the left-handed player) of the mat and over each of the contact plate and the tee peg. For each of the swing paths, the golfer's toes are placed in position perpendicularly to and to the outside of the alignment rod.

Thus has been broadly outlined the more important features of the present golf swing training device so that the detailed description thereof that follows may be better understood and in order that the present contribution to the art may be better appreciated.

BRIEF DESCRIPTION OF THE DRAWINGS FIGURES

DETAILED DESCRIPTION OF THE DRAWINGS

Figure 1:
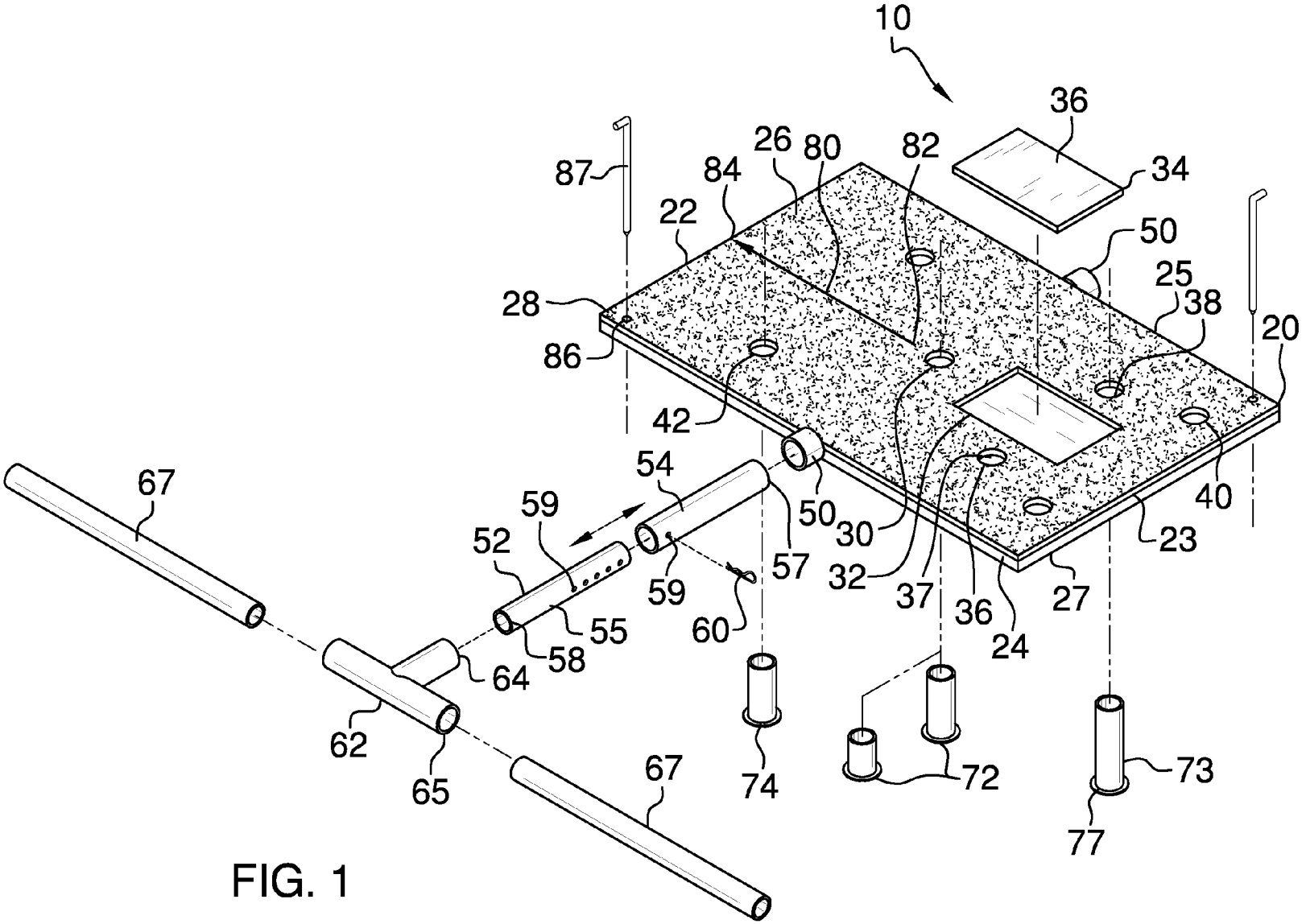
FIG. 1 is an exploded isometric view showing three pegs to be inserted for a swing path for a right-handed golfer's iron swing.
Figure 2:
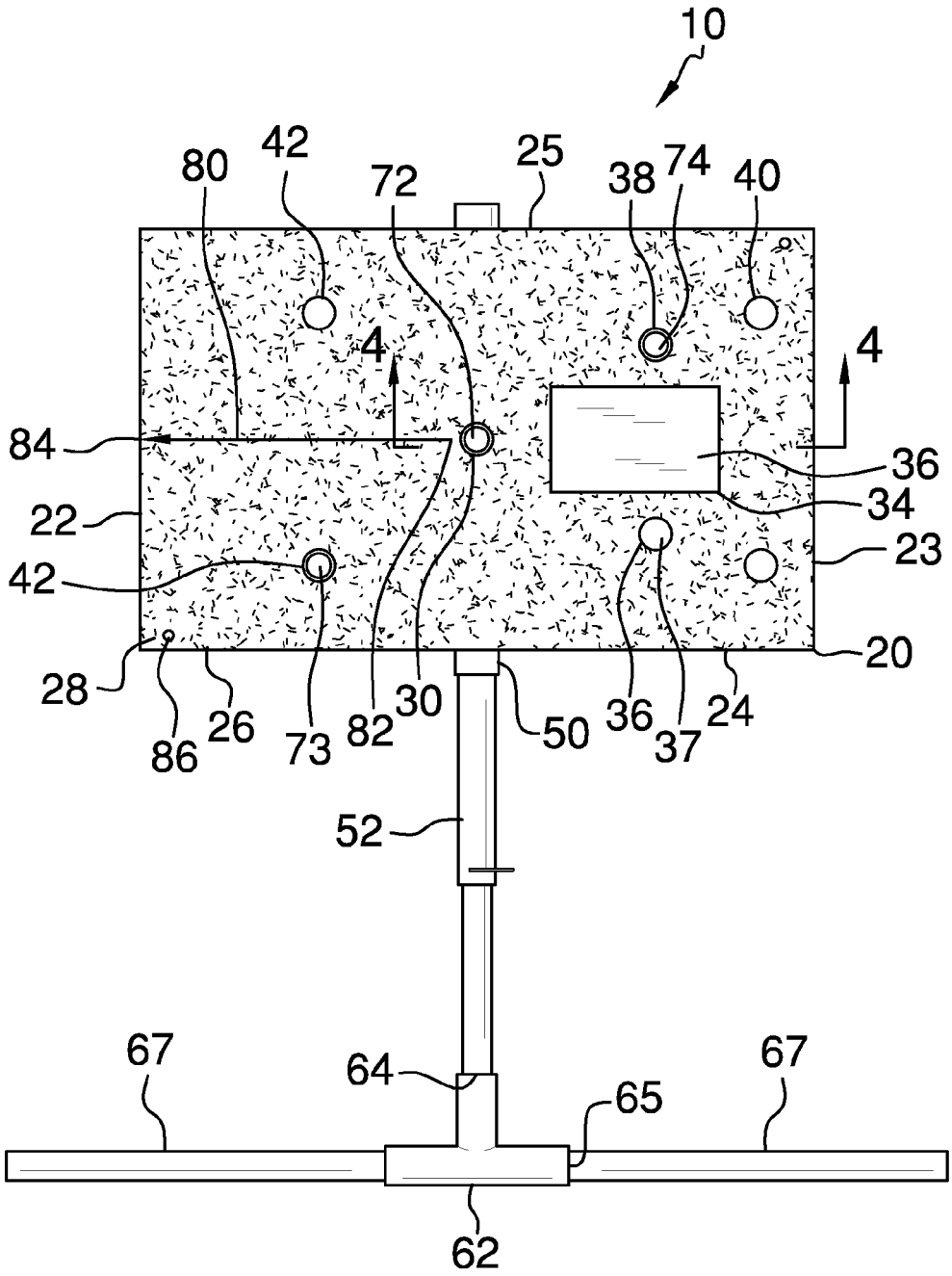
FIG. 2 is a top plan view showing the pegs inserted in the same position as shown in FIG. 1.
Figure 3:
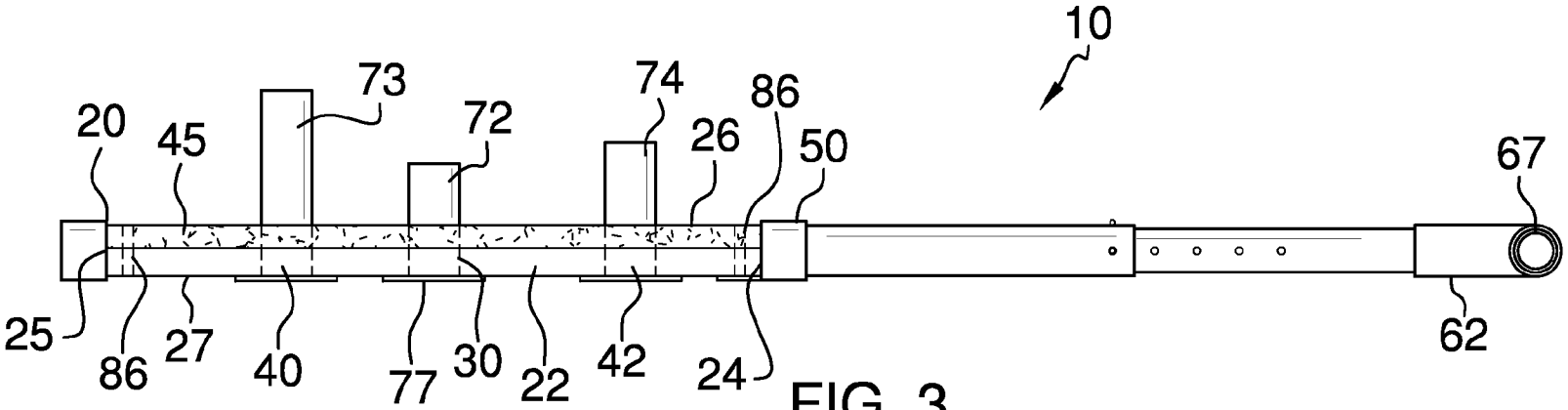
FIG. 3 is a front elevation view showing the pegs inserted in the same position as shown in FIG. 1.
Figure 4:
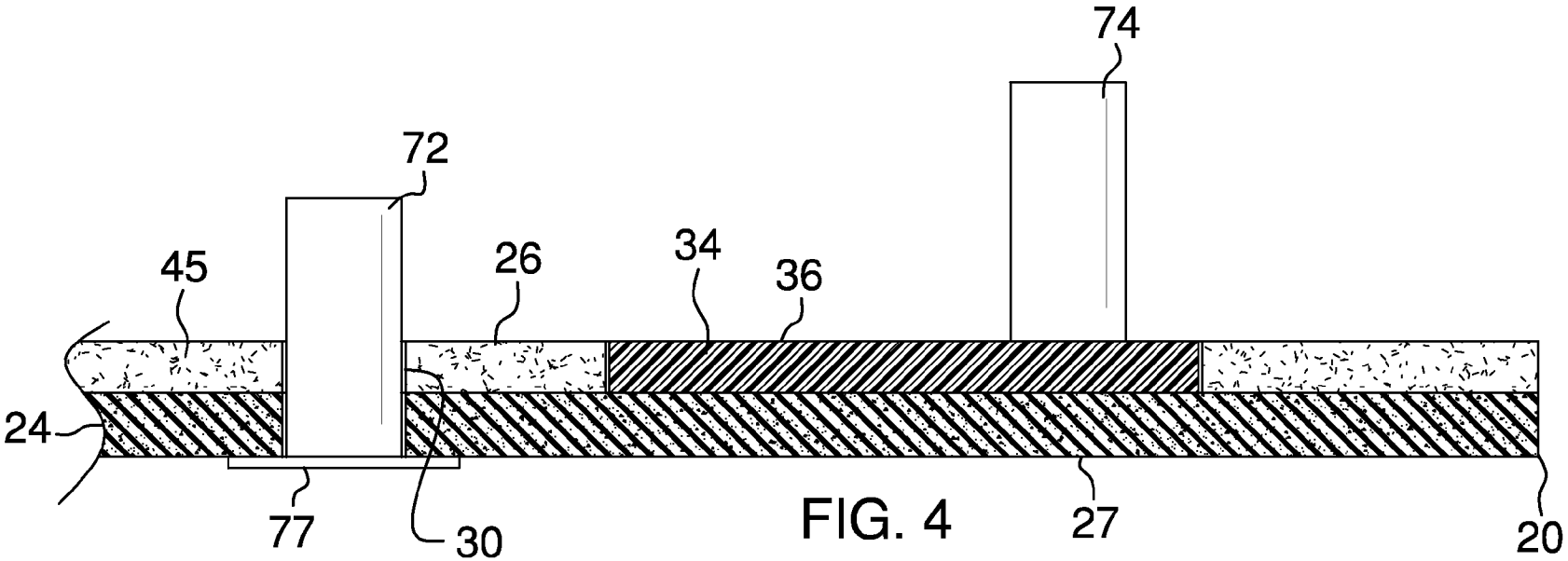
FIG. 4 is a cross-sectional view taken along line 4-4 of FIG. 2.
Figure 5:
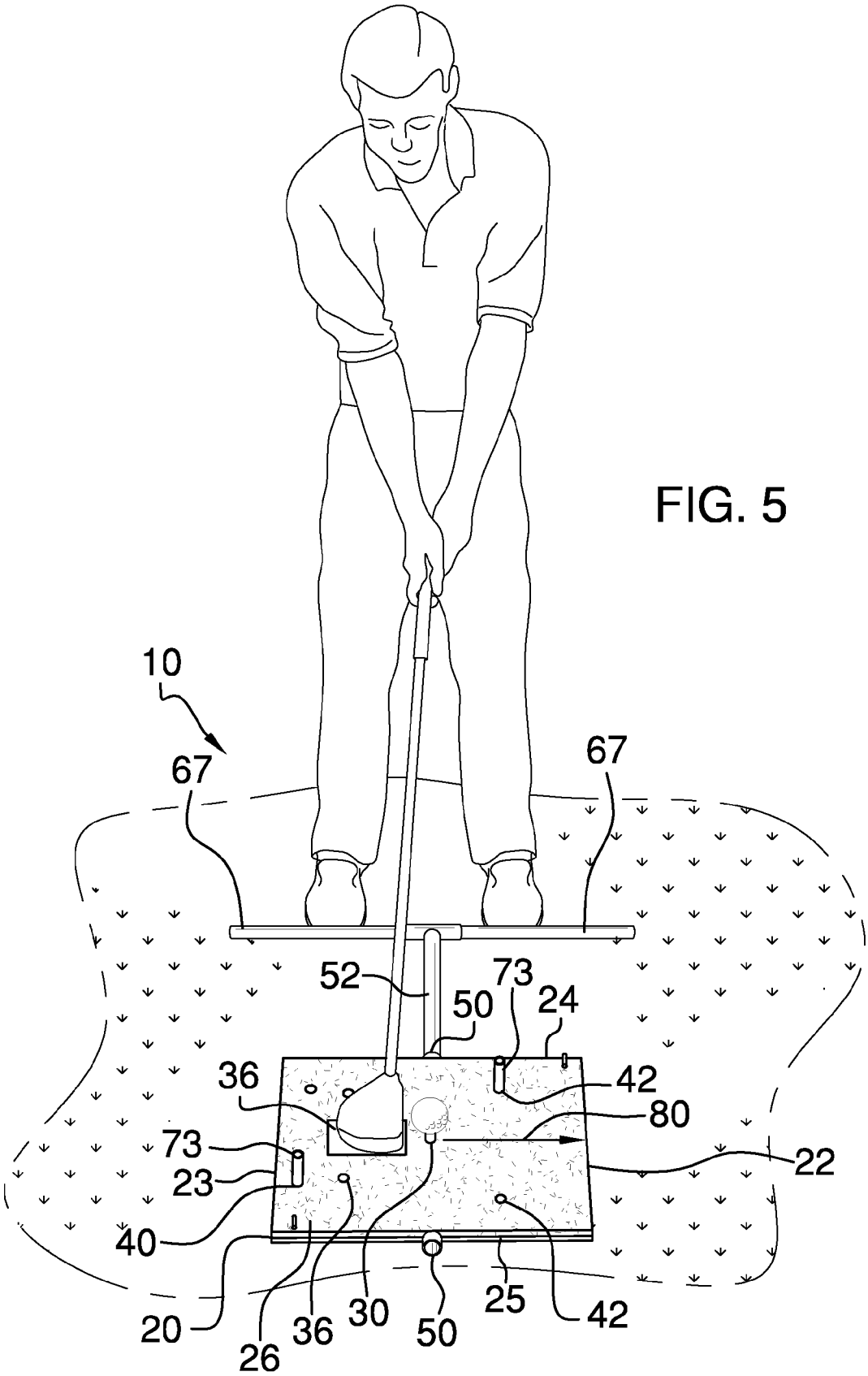
FIG. 5 is an in-use view showing the pegs inserted for a swing path for a right-handed golfer's driver and wood swing.

With reference now to the drawings, and in particular FIGS. 1 through 5 thereof, an example of the instant golf swing training device employing the principles and concepts of the present golf swing training device and generally designated by the reference number 10 will be described.

Referring to FIGS. 1 through 5, the present golf swing training device 10 is illustrated. The golf swing training device 10 is provided to teach a golfer correct body alignment with respect to a target location on a golf course, such as a pin on the green, as well as a consistently correct golf swing that ultimately improves the golfer's score. Repetitive golf swings using the present device will increase consistency in the golfer's club swing. The instant device 10 includes a planar mat 20 over which a golfer strikes a golf ball. The mat 20 has a front end 22, a rear end 23, a right side 24, a left side 25, a top surface 26, and a non-slip bottom surface 27. The mat 20 also has four diametrically opposed corners 28. A central aperture 30 is centrally disposed in the mat 20 in a location upon which a golf tee is typically placed when hitting a golf ball from a tee box.

In addition, a rectangular contact cavity 32 is positioned in a location behind the central aperture 30 where the golf club should pass over when correctly hitting a golf ball from a golf tee or in a fairway. The contact cavity 32 is centrally disposed in the mat 20 between the right side 24, the left side 25, and the bottom surface 27 in a longitudinal position between the front end 22 and the central aperture 30. A contact plate 34 is disposed within the entire contact cavity 32. The contact plate 34 has an upper surface 36 disposed in a position flush with the mat 20 top surface 26. The purpose of the contact plate 34 is to provide practice to teach a golfer correct ball contact. If the club contact is incorrect, the golfer will hit the contact plate 34 with the golf club. The contact plate 34 is durable and resilient to prevent damage to a golf club upon contact with the contact plate 34.

The present device 10 also includes a pair of circular side apertures 36 disposed in the mat 20. The side apertures 36 include a first side aperture 37 disposed between the contact cavity 32 and the right side 24 and a second side aperture 38 disposed between the contact cavity 32 and the left side 25 of the mat 20. Each of the first and second side apertures 37, 38 is disposed in a position more proximal the contact cavity 32 than the respective right side 24 and left side 25. A pair of circular rear apertures 40 is also disposed in the mat 20. One rear aperture 40 is disposed between each of the first side aperture 37 and the second side aperture 38 and the rear end 23 of the mat 20 in an offset position toward the respective right and left sides 24, 25 of the mat 20. The rear apertures 40 are disposed more proximal the rear end 20 than each of the respective right and left sides 24, 25 of the mat 20. A pair of circular front apertures 42 is centrally disposed between the central aperture 30, the front end 22 of the mat 20, and the respective right side 24 and left side 25.

A synthetic turf 45 covers the entire top surface 26 unoccupied by the contact plate 34, the central aperture 30, the side apertures 36, the rear apertures 40, and the front apertures 42 to simulate the turf on a golf course thereby aiding the golfer to practice correct golf swings with visual and physical cues provided by the instant device 10.

The present device 10 also trains a golfer in proper feet placement during a golf swing. To this end, a cylindrical female connector 50 is attached to the right and left sides 24, 25 of the mat 20. A cylindrical alignment tube 52 is attached to the female connector 50. The alignment tube 52 is fixed in length and alternately is telescopic. The telescopic alignment tube 52 has a first portion 54 and a second portion 55 that slidingly engages the first portion 54. The first portion 54 has an inner edge 57 attached to the respective female connector 50, while the second portion 55 has an outer edge 58. The first portion 54 has a single opening 59 and the second portion 55 has a plurality of openings 59 alignable with the single opening 59 of the first portion 54. A hairpin cotter pin 60 or other fastener engages one of the openings 59 of the second portion 55 and the opening 59 of the first portion 54 upon alignment thereof to secure the first and second portions 54, 55 of the alignment tube 52 together at a selected distance from a respective right or left side 24, 25 of the mat 20. The telescopic alignment tube 52 is adjustable to accommodate the swing plane of a golfer based on factors such as height, arm length, and the length of the particular club used during golf swing practice using the present device 10. A cylindrical T-shaped tube connector 62 is also provided. The tube connector 62 has an inside edge 64 attached to the outer edge 58 of the alignment tube 52 and a pair of outside edges 65 to which a pair of cylindrical alignment rods 67 is attached. Upon attachment to the tube connector 62, the alignment rods 67 are disposed in a position parallel to the respective right side 24 and left side 25 of the mat 20 to accommodate a right-handed and alternately a left-handed golfer.

A plurality of upright pegs 70 configured to engage the central aperture 30, the rear apertures 40, the front apertures 42, and the side apertures 36 in a position vertical to the top surface 26 of the mat 20 is also provided. The pegs 70 are selectively disposed in the apertures to permit a golfer to define a desired club swing path for the woods and the driver as well as for irons for either a left-handed or a right-handed golfer. The pegs 70 include tee pegs 72 that serve as a tee for a golf ball, elongated pegs 73, and mid-length pegs 74. At least two tee pegs 72 are provided with one of the tee pegs 72 having a shorter length than a length of the other tee peg 72. The tee pegs 72 engage the central aperture 30. The pair of elongated pegs 73 is used in conjunction with golf swing practice using the woods and the driver. The elongated pegs 73 engage one of the rear apertures 40 and the front apertures 42. The pair of mid-length pegs 74 is used in conjunction with golf swing practice using irons. Each mid-length peg 74 is shorter than one of the elongated pegs 73 and longer than the longer of the two tee pegs 72. The mid-length pegs 74 engage one of the side apertures 36 and one of the front apertures 42. Each of the elongated peg 73, mid-length pegs 74, and tee pegs 72 is durable and resilient, such as being formed with rubber or a rubberlike substance, to prevent damage to a golf club making contact therewith, such as when a golfer executes an incorrect golf swing. Each peg 70 has a base 77 having a diameter greater than a diameter of each of the apertures 30, 36, 40, 42 to secure the peg 70 on the bottom surface 27 of the mat 20.

An alignment arrow 80 is continuously centrally disposed on the top surface 26 of the mat 20 with a rearward end 82 of the alignment arrow 80 disposed proximal the central aperture 30 and a pointed end 84 disposed proximal the front end 22 of the mat 20. The alignment arrow 80 trains a golfer to swing a club in a correct swing path by providing a visual aid for a correct forward follow through during a swing.

A plurality of stake holes 86 disposed through the mat 20 permits outdoor use of the present device 10. Each stake hole 86 is disposed proximal to one of a pair of diametrically opposed corners 28. Stakes 87 engage the stake holes 86 to secure the mat 20 to a ground surface. The non-slip bottom surface 27 of the mat 20 permits the device 10 to be used without the stakes 87 for indoor use, such as during inclement weather.

To use the present device 10, a golfer selects a desired swing path. A first swing path is defined by an area of the top surface 26 of the mat 20 between the elongated peg 73 disposed in the rear aperture 40 proximal the right side 24 of the mat 20 and the elongated peg 73 disposed in the front aperture 42 proximal the left side 25 of the mat 20 and over each of the contact plate 36 and the tee peg 72. The first swing path is used to train a right-handed golfer to swing one of a wood club and a golf driver upon the positioning of the golfer's toes perpendicularly to the alignment rods 67.

A second swing path is defined by an area of the top surface 26 of the mat 20 between the elongated peg 73 disposed in the rear aperture 40 proximal the left side 25 and the elongated peg 73 disposed in the front aperture 42 proximal the right side 24 and over each of the contact plate 36 and the tee peg 72. The second swing path is used to train a left-handed golfer to swing one of a wood club and a golf driver upon the positioning of the golfer's toes perpendicularly to the alignment rods 67.

A third swing path is defined by an area of the top surface 26 of the mat 20 between the mid-length peg 74 disposed in the first side aperture 37 and the elongated peg 73 disposed in the front aperture 42 proximal the left side 25 and over each of the contact plate 36 and the tee peg 72. The third swing path is used to train a right-handed golfer to swing one of an iron upon the positioning of the golfer's toes perpendicularly to the alignment rod.

A fourth swing path defined by an area of the mat 20 top surface 26 between the mid-length peg 74 disposed in the second side aperture 38 and the elongated peg 74 disposed in the front aperture 42 proximal the mat 20 right side 24 and over each of the contact plate 36 and the tee peg 72. The fourth swing path is used to train a left-handed golfer to swing one of an iron upon the positioning of the golfer's toes perpendicularly to the alignment rod.

The mat 20 has a width of 10 inches and a length of 16 inches. The contact plate 36 has a width of 2½ inches and a length of 4 inches. Each of the mid-length pegs 74 has a length extending 1½ inches from the mat 20 top surface 26. Each of the elongated pegs 73 has a length extending 2½ inches from the mat 20 top surface 26. The fixed alignment tube has a fixed length of 10 inches. The foregoing dimensions may vary as long as the purposes and use of the present device 10 are served.

What is claimed is:

1. A golf swing training device comprising:

a planar mat having a front end, a rear end, a right side, a left side, a top surface, a bottom surface;

a central aperture centrally disposed in the mat;

a rectangular contact cavity centrally disposed between the right side, the left side, and the bottom surface in a longitudinal position between the front end and the central aperture;

a contact plate disposed within the entire contact cavity, the contact plate having an upper surface disposed in flush position with the mat top surface;

a pair of circular side apertures, the side apertures comprising a first side aperture disposed between the contact cavity and the right side and a second side aperture disposed between the contact cavity and the left side of the mat, each of the first and second side apertures disposed in a position more proximal the contact cavity than the respective right side and left side;

a pair of circular rear apertures, one rear aperture disposed between each of the first side aperture and the second side aperture and the rear end of the mat in an offset position toward the respective right and left sides of the mat, the rear apertures disposed more proximal the rear end than each of the respective right and left sides of the mat;

a pair of circular front apertures centrally disposed between the central aperture, the front end of the mat, and the respective right side and left side;

a female connector attached to each of the right side and the left side of the mat;

an alignment tube having an inner edge attached to the respective female connector and an outer edge;

a T-shaped tube connector having an inside edge attached to the outer edge of the alignment tube and a pair of outside edges;

a pair of alignment rods, one of the alignment rods attached to a respective one of the outside edges of the tube connector, wherein the alignment rod is disposed in a position parallel to the female connector on the respective right side and left side of the mat; and a plurality of pegs, wherein the pegs are configured to engage the central aperture, the rear apertures, the front apertures, and the side apertures in a position vertical to the top surface of the mat.

2. The golf swing training device of claim 1 further comprising:

an alignment arrow continuously centrally disposed on the top surface of the mat, the alignment arrow having a rearward end disposed proximal the central aperture and a pointed end disposed proximal the front end of the mat.

3. The golf swing training device of claim 2 further comprising:

a plurality of stake holes disposed through the mat;

a plurality of stakes; and wherein each stake hole is configured to receive one of the stakes therethrough.

4. The golf swing training device of claim 3 wherein the stakes are configured to secure the mat to a ground surface.

5. The golf swing training device of claim 1 further comprising:

a plurality of stake holes disposed through the mat;

a plurality of stakes; and wherein each stake hole is configured to receive one of the stakes therethrough.

6. The golf swing training device of claim 5 wherein the stakes are configured to secure the mat to a ground surface.

7. A golf swing training device comprising:

a planar mat having a front end, a rear end, a right side, a left side, a top surface, a bottom surface;

a central aperture centrally disposed in the mat;

a rectangular contact cavity centrally disposed between the right side, the left side, and the bottom surface in a longitudinal position between the front end and the central aperture;

a contact plate disposed within the entire contact cavity, the contact plate having an upper surface disposed in a position flush with the mat top surface;

a pair of circular side apertures, the side apertures comprising a first side aperture disposed between the contact cavity and the right side and a second side aperture disposed between the contact cavity and the left side of the mat, each of the first and second side apertures disposed in a position more proximal the contact cavity than the respective right side and left side;

a pair of circular rear apertures, one rear aperture disposed between each of the first side aperture and the second side aperture and the rear end of the mat in an offset position toward the respective right and left sides of the mat, the rear apertures disposed more proximal the rear end than each of the respective right and left sides of the mat;

a pair of circular front apertures centrally disposed between the central aperture, the front end of the mat, and the respective right side and left side;

a female connector attached to each of the right side and the left side of the mat;

an alignment tube having an inner edge attached to the respective female connector and an outer edge;

a T-shaped tube connector having an inside edge attached to the outer edge of the alignment tube and a pair of outside edges;

a pair of alignment rods, one of the alignment rods attached to a respective one of the outside edges of the tube connector, wherein the alignment rod is disposed in a position parallel to the female connector on the respective right side and left side of the mat;

at least two tee pegs, wherein one of the tee pegs has a shorter length than a length of the other tee peg;

wherein each of the tee pegs is configured to engage the central aperture in a position vertical to the top surface of the mat;

a pair of elongated pegs;

wherein each of the elongated pegs is configured to engage one of the rear apertures and the front apertures in a position vertical to the top surface of the mat;

a pair of mid-length pegs having a length shorter than the elongated pegs and longer than the longer of the two tee pegs; and wherein each of mid-length pegs is configured to engage one of the side apertures in a position vertical to the top surface of the mat.

8. The golf swing training device of claim 7 further comprising:

a first swing path defined by an area of the top surface of the mat between the elongated peg disposed in the rear aperture proximal the right side of the mat and the elongated peg disposed in the front aperture proximal the left side of the mat and over each of the contact plate and the tee peg;

a second swing path defined by an area of the top surface of the mat between the elongated peg disposed in the rear aperture proximal the left side of the mat and the elongated peg disposed in the front aperture proximal the right side of the mat and over each of the contact plate and the tee peg;

a third swing path defined by an area of the top surface of the mat between the mid-length peg disposed in the first side aperture and the elongated peg disposed in the front aperture proximal the left side of the mat and over each of the contact plate and the tee peg; and a fourth swing path defined by an area of the mat top surface between the mid-length peg disposed in the second side aperture and the elongated peg disposed in the front aperture proximal the right side of the mat and over each of the contact plate and the tee peg.

9. The golf swing training device of claim 8 further comprising:

an alignment arrow continuously centrally disposed on the top surface of the mat, the alignment arrow having a rearward end disposed proximal the central aperture and a pointed end disposed proximal the front end of the mat.

10. The golf swing training device of claim 9 further comprising:

a plurality of stake holes disposed through the mat;

a plurality of stakes; and wherein each stake hole is configured to receive one of the stakes therethrough.

11. The golf swing training device of claim 10 wherein the stakes are configured to secure the mat to a ground surface.

12. The golf swing training device of claim 7 further comprising:

an alignment arrow continuously centrally disposed on the top surface of the mat, the alignment arrow having a rearward end disposed proximal the central aperture and a pointed end disposed proximal the front end of the mat.

13. The golf swing training device of claim 7 further comprising:

a plurality of stake holes disposed through the mat;

a plurality of stakes; and wherein each stake hole is configured to receive one of the stakes therethrough.

14. The golf swing training device of claim 13 wherein the stakes are configured to secure the mat to a ground surface.

15. A golf swing training device comprising:

a planar mat having a front end, a rear end, a right side, a left side, a top surface, a non-slip bottom surface, and four diametrically opposed corners;

a central aperture centrally disposed in the mat;

a rectangular contact cavity centrally disposed between the right side, the left side, and the bottom surface in a longitudinal position between the front end and the central aperture;

a contact plate disposed within the entire contact cavity, the contact plate having an upper surface disposed in a position flush with the mat top surface;

a pair of circular side apertures, the side apertures comprising a first side aperture disposed between the contact cavity and the right side and a second side aperture disposed between the contact cavity and the left side of the mat, each of the first and second side apertures disposed in a position more proximal the contact cavity than the respective right side and left side;

a pair of circular rear apertures, one rear aperture disposed between each of the first side aperture and the second side aperture and the rear end of the mat in an offset position toward the respective right and left sides of the mat, the rear apertures disposed more proximal the rear end than each of the respective right and left sides of the mat;

a pair of circular front apertures centrally disposed between the central aperture, the front end of the mat, and the respective right side and left side;

a synthetic turf disposed on the entire top surface unoccupied by the contact plate, the central aperture, the side apertures, the rear apertures, and the front apertures;

a cylindrical female connector attached to each of the right side and the left side of the mat;

a cylindrical telescopic alignment tube having a first portion and a second portion slidingly engaging the first portion, the first portion having an inner edge attached to the respective female connector, the second portion having an outer edge, the first portion having a single opening and the second portion having a plurality of openings alignable with the single opening of the first portion;

a cylindrical T-shaped tube connector having an inside edge attached to the outer edge of the alignment tube and a pair of outside edges;

a pair of cylindrical alignment rods, one of the alignment rods attached to a respective one of the outside edges of the tube connector, wherein the alignment rod is disposed in a position parallel to the female connector on the respective right side and left side of the mat;

at least two tee pegs, wherein one of the tee pegs has a shorter length than a length of the other tee peg;

wherein each of the tee pegs is configured to engage the central aperture in a position vertical to the top surface of the mat;

a pair of elongated pegs;

wherein each of the elongated pegs is configured to engage one of the rear apertures and the front apertures in a position vertical to the top surface of the mat;

a pair of mid-length pegs having a length shorter than the elongated pegs and longer than the longer of the two tee pegs;

wherein each of mid-length pegs is configured to engage one of the side apertures in a position vertical to the top surface of the mat;

an alignment arrow continuously centrally disposed on the top surface of the mat, the alignment arrow having a rearward end disposed proximal the central aperture and a pointed end disposed proximal the front end of the mat;

a plurality of stake holes disposed through the mat, each stake hole disposed proximal to one of a pair of the diametrically opposed corners;

a plurality of stakes;

wherein each stake hole is configured to receive one of the stakes therethrough; and wherein the stakes are configured to secure the mat to a ground surface.

16. The golf swing training device of claim 15 further comprising a hairpin cotter pin, wherein the cotter pin engages one of the holes of the second portion and the hole of the first portion upon alignment thereof.

17. The golf swing training device of claim 16 further comprising:

a first swing path defined by an area of the top surface of the mat between the elongated peg disposed in the rear aperture proximal the right side of the mat and the elongated peg disposed in the front aperture proximal the left side of the mat and over each of the contact plate and the tee peg;

wherein the first swing path is configured to be used to train a right-handed golfer to swing one of a wood club and a golf driver upon the positioning of the golfer's toes perpendicularly to the alignment rods;

a second swing path defined by an area of the top surface of the mat between the elongated peg disposed in the rear aperture proximal the left side of the mat and the elongated peg disposed in the front aperture proximal the right side of the mat and over each of the contact plate and the tee peg;

wherein the second swing path is configured to be used to train a left-handed golf to swing one of a wood club and a golf driver upon the positioning of the golfer's toes perpendicularly to the alignment rods;

a third swing path defined by an area of the top surface of the mat between the mid-length peg disposed in the first side aperture and the elongated peg disposed in the front aperture proximal the left side of the mat and over each of the contact plate and the tee peg;

wherein the third swing path is configured to be used to train a right-handed golfer to swing one of an iron upon the positioning of the golfer's toes perpendicularly to the alignment rods;

a fourth swing path defined by an area of the top surface of the mat between the mid-length peg disposed in the second side aperture and the elongated peg disposed in the front aperture proximal the right side of the mat and over each of the contact plate and the tee peg; and wherein the fourth swing path is configured to be used to train a left-handed golfer to swing one of an iron upon the positioning of the golfer's toes perpendicularly to the alignment rods.

18. The golf swing training device of claim 17 wherein the contact plate is durable and resilient;

wherein each elongated peg, each mid-length peg, and each tee peg is durable and resilient;

wherein the mat has a width of 10 inches and a length of 16 inches;

wherein the contact plate has a width of 2½ inches and a length of 4 inches;

wherein each of the mid-length pegs has a length extending 1½ inches from the top surface of the mat;

wherein each of the elongated pegs has a length extending 2½ inches from the top surface of the mat;

wherein each of the tee pegs has a length extending ⅜ inch from the top surface of the mat;

wherein the alignment tube retracts to a minimum length of 6 inches and extends to a maximum length of 12 inches; and wherein each of the alignment rods has a length in a range of 7 inches to 10 inches.

19. The golf swing training device of claim 15 further comprising:

a first swing path defined by an area of the top surface of the mat between the elongated peg disposed in the rear aperture proximal the right side of the mat and the elongated peg disposed in the front aperture proximal the left side of the mat and over each of the contact plate and the tee peg;

wherein the first swing path is configured to be used to train a right-handed golfer to swing one of a wood club and a golf driver upon the positioning of the golfer's toes perpendicularly to the alignment rods;

a second swing path defined by an area of the top surface of the mat between the elongated peg disposed in the rear aperture proximal the left side of the mat and the elongated peg disposed in the front aperture proximal the right side of the mat and over each of the contact plate and the tee peg;

wherein the second swing path is configured to be used to train a left-handed golf to swing one of a wood club and a golf driver upon the positioning of the golfer's toes perpendicularly to the alignment rods;

a third swing path defined by an area of the mat top surface between the mid-length peg disposed in the first side aperture and the elongated peg disposed in the front aperture proximal the left side of the mat and over each of the contact plate and the tee peg;

wherein the third swing path is configured to be used to train a right-handed golfer to swing one of an iron upon the positioning of the golfer's toes perpendicularly to the alignment rods;

a fourth swing path defined by an area of the mat top surface between the mid-length peg disposed in the second side aperture and the elongated peg disposed in the front aperture proximal the right side of the mat and over each of the contact plate and the tee peg; and wherein the fourth swing path is configured to be used to train a left-handed golfer to swing one of an iron upon the positioning of the golfer's toes perpendicularly to the alignment rods.

20. The golf swing training device of claim 15 wherein the mat has a width of 10 inches and a length of 16 inches;

wherein the contact plate has a width of 2½ inches and a length of 4 inches;

wherein each of the mid-length pegs has a length extending 1½ inches from the top surface of the mat;

wherein each of the elongated pegs has a length extending 2½ inches from the top surface of the mat;

wherein each of the tee pegs has a length extending ⅜ inch from the top surface of the mat;

wherein the alignment tube retracts to a minimum length of 6 inches and extends to a maximum length of 12 inches; and wherein each of the alignment rods has a length in a range of 7 inches to 10 inches.

* * * * *